US012187521B2

(12) United States Patent
Uribe et al.

(10) Patent No.: US 12,187,521 B2
(45) Date of Patent: Jan. 7, 2025

(54) MICROWAVABLE PACKAGES AND FOOD PRODUCTS

(71) Applicant: Kraft Foods Group Brands LLC, Chicago, IL (US)

(72) Inventors: Travis Dillion Uribe, Chicago, IL (US); Jacob M. Parker, Chicago, IL (US)

(73) Assignee: Kraft Foods Group Brands LLC, Chicago, IL (US)

( * ) Notice: Subject to any disclaimer, the term of this patent is extended or adjusted under 35 U.S.C. 154(b) by 1135 days.

(21) Appl. No.: 16/464,731

(22) PCT Filed: Nov. 28, 2017

(86) PCT No.: PCT/US2017/063359

§ 371 (c)(1),
(2) Date: May 29, 2019

(87) PCT Pub. No.: WO2018/102273

PCT Pub. Date: Jun. 7, 2018

(65) Prior Publication Data

US 2021/0070525 A1 Mar. 11, 2021

Related U.S. Application Data

(60) Provisional application No. 62/428,314, filed on Nov. 30, 2016.

(51) Int. Cl.
*B65D 81/26* (2006.01)
*B65D 81/34* (2006.01)

(52) U.S. Cl.
CPC ..... *B65D 81/264* (2013.01); *B65D 81/3453* (2013.01); *B65D 2581/3417* (2013.01);
(Continued)

(58) Field of Classification Search
CPC .. B65D 81/26; B65D 81/264; B65D 81/3453; B65D 2581/3417; B65D 2581/3471; B65D 2581/3498
See application file for complete search history.

(56) References Cited

U.S. PATENT DOCUMENTS

2004/0023000 A1 * 2/2004 Young ..... B65D 81/3446 428/35.2
2006/0049190 A1 3/2006 Middleton
(Continued)

FOREIGN PATENT DOCUMENTS

| | | | | |
|---|---|---|---|---|
| JP | 2009274770 | | 11/2009 | |
| JP | 2011515281 | A | 5/2011 | |
| JP | 2013129435 | | 7/2013 | |
| WO | 2004/013015 | A1 | 2/2004 | |
| WO | WO-2008098156 | A1 * | 8/2008 | ..... B65D 81/264 |
| WO | 2009/114038 | A1 | 9/2009 | |

OTHER PUBLICATIONS

International Search Report and Written Opinion for PCT/US2017/063359, mailed Feb. 2, 2018 (10 pages).

*Primary Examiner* — Eli D. Strah
*Assistant Examiner* — Thomas J Kessler
(74) *Attorney, Agent, or Firm* — Fitch, Even, Tabin & Flannery LLP

(57) ABSTRACT

In some embodiments, apparatuses and methods are disclosed herein useful to provide convenient, microwavable packages for cooking and crisping food products in a microwave oven are. In some embodiments, the microwavable packaged food product includes an outer package and a quantity of food product contained therein. By one approach, the package has a multilayer microwavable tray having at least three layers including a susceptor layer that includes a microwave energy interactive material thereon and a plurality of discrete openings disposed therein, an absorbent pad layer having a flexible paper-based material suitable for absorbing moisture and grease, and a paperboard base layer that provides a structure by which the susceptor
(Continued)

layer and absorbent paper-based layer are supported. In this manner, a microwavable tray or support has at least three macro-layers including a susceptor, an absorbent pad, and a paperboard support, some of which may include additional layers therein as discussed below.

30 Claims, 12 Drawing Sheets

(52) U.S. Cl.
CPC ..... *B65D 2581/3471* (2013.01); *B65D 2581/3498* (2013.01)

(56) References Cited

U.S. PATENT DOCUMENTS

| | | | | |
|---|---|---|---|---|
| 2007/0158339 | A1* | 7/2007 | Beckman | A47J 36/027 219/734 |
| 2009/0302032 | A1 | 12/2009 | Middleton | |
| 2010/0012652 | A1 | 1/2010 | Cole | |
| 2010/0059511 | A1* | 3/2010 | Gowens | H05B 6/6408 219/730 |
| 2012/0000905 | A1* | 1/2012 | Noyelle | B65D 5/5038 219/730 |

* cited by examiner

MICROWAVABLE PACKAGES AND FOOD PRODUCTS

CROSS-REFERENCE TO RELATED APPLICATION

This application is a U.S. national phase application filed under 35 U.S.C. § 371 of International Application Number PCT/US2017/063359, filed Nov. 28, 2017, designating the United States, which claims the benefit of U.S. Provisional Application No. 62/428,314 filed Nov. 30, 2016, which is incorporated herein by reference in its entirety.

TECHNICAL FIELD

This relates generally to packaged food products, and to packages for shipping, retail display, storage and microwave cooking of convenience food products.

BACKGROUND

Convenience food items require little preparation by consumers and can be eaten shortly after purchasing or heating in a microwave oven. One of the problems associated with the use of microwave energy (i.e., electromagnetic radiation at a frequency of about 0.3 to 300 GHz, commonly about 2.45 GHz) for cooking of food items in microwave ovens is nonuniformity of heating of the food items. Substantial temperature variation may be present where uniformity of temperature is desired. The problem is in part due to the fact that power distribution in the oven cavity is typically non-uniform. The non-uniform power density gives rise to "hot spots" and "cold spots" within the cavity.

Also contributing to the problem is the fact that a food item generally does not exhibit uniform temperature response to microwave radiation throughout its volume during a typical heating cycle. In particular, when a food item is subjected to microwave radiation, certain portions of the item may cook before other portions, and may become overcooked while other portions remain undercooked.

Numerous efforts have been made to address the problem of uniformity of heating. Various types of turntables, susceptors, reflectors, and shields have been proposed as solutions. However, devices which are useful in certain commercially available microwave ovens may not exhibit acceptable performance in other ovens, due to variations in power, cavity size and field configuration. Also, some devices which may improve cooking are unacceptable due to their tendency to cause arcing or sparking. Furthermore, devices which shield a food item and/or reflect radiation away from the food item may increase the cooking time of the food item. Typical food items have non-homogenous thermal resistivity and non-homogenous dielectric properties. Furthermore, the dielectric properties of such items often vary during cooking. These factors tend to further complicate efforts to improve cooking rate and uniformity. Among the considerations that may be taken into account in developing new convenience food items is the ability of the packaging to facilitate microwave heating while addressing these problems.

One popular food item that poses particular challenges is bacon, due to the nonuniformity of strips of bacon, the grease and moisture that remain during and after cooking, and the tendency of bacon strips to change dimensions and shape during cooking.

BRIEF DESCRIPTION OF THE DRAWINGS

Disclosed herein are embodiments of systems, apparatuses and methods pertaining to microwavable packages and food items. This description includes drawings, wherein.

Figure 1:
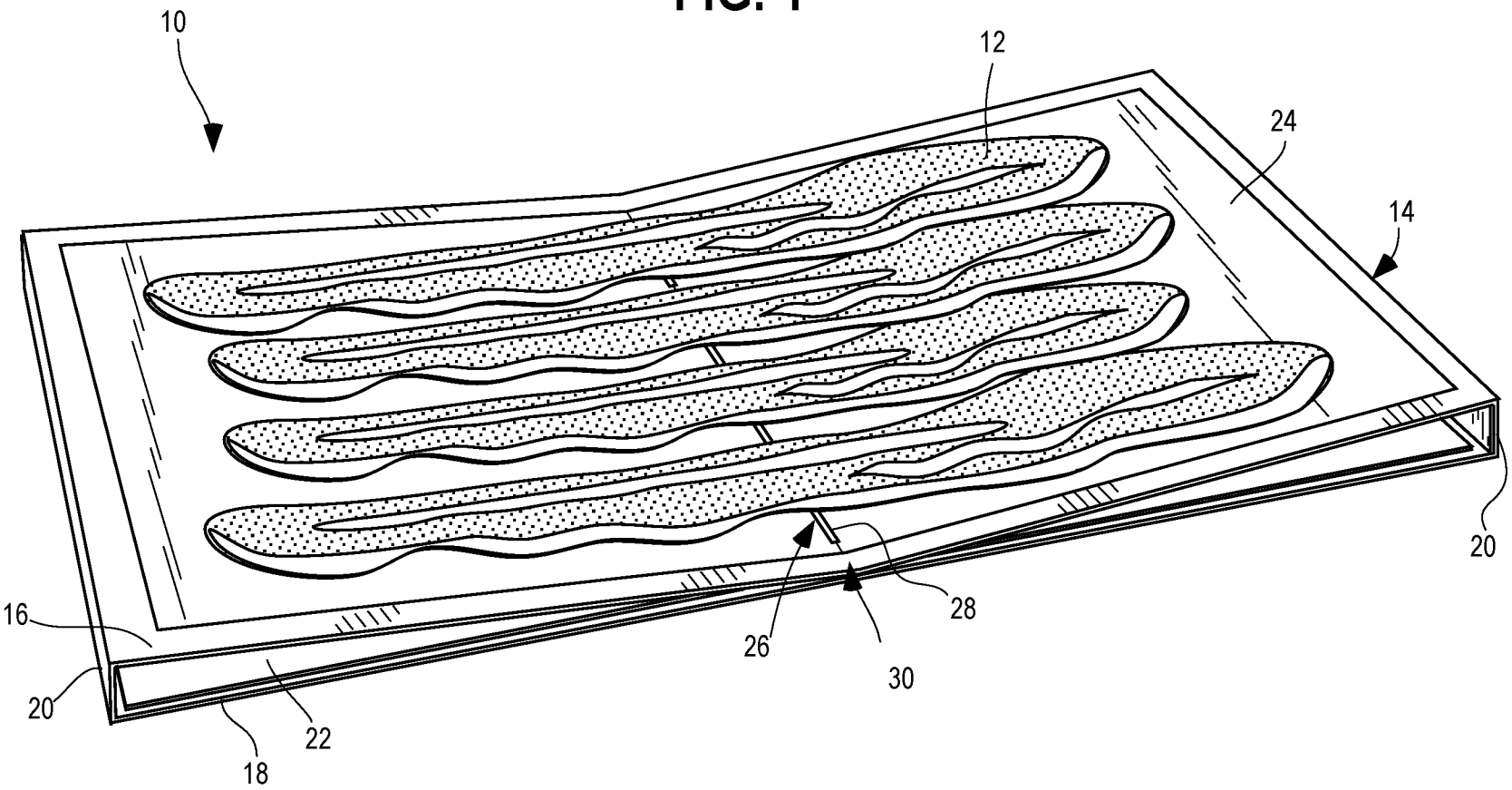
FIG. 1 is a top perspective of a food package in accordance with some embodiments.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to various embodiments, convenient, microwavable packages for cooking and crisping food products, such as raw bacon or other meats, in a microwave oven are described herein. In some embodiments, the microwavable packaged food product includes an outer package and a quantity of food product contained therein, where the packaged food product may be heated in a microwave oven. By one approach, the package has a flat, multilayer microwavable support or tray having at least three layers including a susceptor layer that includes a microwave energy interactive material thereon and a plurality of discrete openings disposed therein, an absorbent pad layer having a flexible paper-based material suitable for absorbing moisture and grease, and a paperboard base layer that provides a structure by which the susceptor layer and absorbent paper-based layer are supported. In this manner, a microwavable tray or support has at least three macro-layers including a susceptor, an absorbent pad, and a paperboard support, some of which may include additional layers therein as discussed below. In one embodiment, the susceptor is adhered to the paperboard base (on a side of the susceptor opposite the product-contacting surface thereof) and the paperboard base is adhered to the absorbent pad. In another embodiment, the absorbent pad is disposed in between the susceptor and the paperboard base. As used herein, the paperboard base generally supports the weight of the food product thereon and the susceptor is the macro layer of the support or tray that contacts the product.

In one illustrative approach, the susceptor is a metallized poly-film laminated to a paper layer with a poly-layer on the bottom. More specifically, in one example the susceptor layer includes a multilayer flexible structure having at least a top product-contacting layer with a metallized material having the microwave energy interactive material thereon and a paper layer (which may include additional paper or poly-layers for functionality). In another example, the multilayer flexible structure of the susceptor layer further includes an additional polymer layer. As used herein, the multilayer flexible structure of the susceptor layer may have a susceptor thickness of between about 0.002-in. to about 0.020-in. Further, the susceptor layer may have a basis weight of between about 40 to about 60 lbs. per 3,000 sq. ft.

In some configurations, the multilayer microwavable support has a top surface area of about 50-in.$^2$ to about 80-in.$^2$. By another approach, the microwavable support has an overall support width of about 9.0-in., an overall support length of about 6.5-in., and a support thickness of between about 0.03-in. to about 0.07-in. Accordingly, in one configuration, the footprint of the support is about 9-in. by about 6.5-in.

As suggested above, the susceptor material or layer may have perforations, holes, or openings therein to facilitate draining of grease and/or moisture from the food-contacting surface of the susceptor. Further, in some configurations, the discrete openings having a higher concentration at a center of the microwavable tray or support. For example, in one illustrative configuration, the discrete openings are disposed in a radial pattern or configuration emanating from the center of the susceptor layer. In some embodiments, the support includes between about 30 to about 80 discrete openings, each having a diameter of between about 0.125-in. to about 0.25-in. In one exemplary embodiment, the microwavable support has a ratio of a susceptor layer area to area of openings of between about 40:1 and about 80:1. By one approach, a greater number of discrete openings are disposed at or near a center of the susceptor layer, which is generally where the grease and moisture pools when cooking bacon and other meats with an even distribution of meat product. In one illustrative approach, the susceptor layer includes about 65 to about 85 discrete openings, a diameter of between about 0.1-in. to about 0.3-in. and a surface area ratio of between about 60:1 to about 70:1. In another configuration, the susceptor layer has about 73 discrete openings, each having a diameter of about 0.125-in, such that the susceptor area ratio is about 64:1 to about 65:1. By having a perforation pattern within these ranges, the food product is cooked and crisped by removing a certain amount of grease to avoid producing a chew and/or greasy result or one that has shrunk significantly. These ranges are particularly suitable for cooking bacon in a way that closely replicates pan fried bacon.

In operation, the paperboard base layer functions as a vehicle or support for the susceptor layer and the absorbent pad, thereby providing the necessary rigidity for holding the food product thereon. The paperboard layer may (or may not) be poly-coated on one or both sides to repel grease and/or moisture. In some configurations, the paperboard base layer has a base thickness of between about 0.010-in. to about 0.030-in. In some embodiments, the basis weight of the paperboard layer is between about 50 to about 80 lbs. per 1,000 sq. ft. By one approach, the paperboard base layer has about a 12-point to about a 16-point thickness. In another approach, the paperboard base layer is about a 14- or about a 16-point solid bleached sulfate. In another approach, the paperboard base is about 0.019-in. to about 0.022-in. thick. Further, while the susceptor layer and the absorbent pad may have a multilayer configuration, the paperboard base layer may have a single layer construction.

As suggested above, in some configurations, the absorbent pad layer is a multilayer flexible structure and may include a paper layer, a clear polyethylene layer, and a non-woven paper-based layer for grease and/or moisture absorption. By one approach, the absorbent pad layer has a pad thickness of between about 0.010-in. and about 0.040-in. and has a basis weight of about 135 lbs./ream (1,000 sq. ft.). By another approach, the absorbent pad has a thickness of about 0.023-in.

As suggested above, the layer of the multilayer microwavable support may be configured in a number of manners. For example, the order of the layers may vary, though the susceptor layer is generally disposed on the food-contacting surface of the support. In addition, the size of the layers may vary with respect to one another. By one approach, the susceptor layer, the absorbent pad layer, and the paperboard base layer are coextensive with one another. By yet another approach, the susceptor layer covers less surface area of the microwavable support than the paperboard base layer. For example, in one approach, the absorbent pad may be disposed only underneath the discrete holes in the susceptor or only under the susceptor. In another example, the absorbent pad may be disposed coextensive with the susceptor layer and/or the paperboard layer. In one illustrative approach, the susceptor layer covers between about 40% to about 60% of an entire support surface area. In another configuration, the paperboard base layer of the microwavable support layer extends beyond the perimeter of the susceptor layer such that a consumer can grasp the paperboard base layer without touching the susceptor layer. In some configurations, the susceptor layer covers less surface area of the microwavable support than the paperboard base layer and the susceptor layer has a circular configuration generally disposed in a center area of the microwavable support. This also permits the perimeter portions of the paperboard base layer to be used for safe handling by the consumer when removing it from the microwave oven, because the area on the edges remain comparatively cooler.

In some embodiments, the package may include a rectangular stand. More particularly, the package may include a rectangular self-erecting stand configured to elevate the multilayer microwavable support or tray from a floor of the microwave. Further, in some configurations, the microwave support may have one or more upstanding flanges disposed at edges of the microwavable support.

In some illustrative approaches, the microwavable packaged food product includes an outer package and a quantity of raw bacon contained therein. In such a configuration, the packaged food product facilitates heating of the food product in a microwave oven, where the bacon comprises at least about 7.5% to about 18.5% protein and the package has a flat, multilayer microwavable support having at least three layers including a susceptor layer with a microwave energy interactive material thereon and a plurality of discrete openings disposed therein disposed in a radial configuration, an absorbent pad layer having a flexible paper-based material suitable for absorbing moisture and grease, and a paperboard base layer by which the susceptor layer and absorbent paper-based layer are supported. In such a configuration, the amount of grease generated during microwave cooking of the bacon that is not absorbed by the support is generally less than about 10%. By one configuration, less than about 8% of the grease is not absorbed by the support. In another configuration, less than about 6% of the grease is not absorbed by the support.

In another illustrative configuration, a raw meat package configured to permit the raw meat to be cooked in a microwave includes an angled or v-stand of paperboard having a susceptor and absorbent pad. By one approach, the microwavable packaged food product includes a multilayer microwavable support having a top support surface and a lower support surface connected by side support walls and an absorbent pad between the top and lower support surfaces, the top support surface, the side support surface, and the side support walls being of a paperboard material. Further, in such a configuration, the top support surface has a susceptor layer disposed thereon, the susceptor layer having a microwave energy interactive material thereon and a plurality of discrete openings disposed therein and the top support surface having an angled configuration with a plurality of discrete openings in the susceptor configured to permit moisture and grease to drain therethrough. Further, by one approach, the absorbent pad layer has a flexible paper-based material suitable for absorbing moisture and grease that drains through the openings in the susceptor to the absorbent pad underneath the top support surface.

In a package having an angled top surface, the susceptor layer may include a multilayer flexible structure having at least a top product-contacting layer with a metallized material having the microwave energy interactive material thereon and a paper layer and the top angled surface having a v-shape with a centrally disposed lowermost drain. Further, in some configurations, at least some of the plurality of discrete openings are disposed in a valley of the angled top support surface. Similar to some of the embodiments discussed above, the discrete openings, in some configurations, are disposed in a radially configuration.

The packages outlined herein provide a quick manner of cooking and crisping meat in the microwave oven with minimal mess by having a susceptor layer permitting quick and even cooking of raw meat (or other foods) and an absorbent pad for managing any oils, grease, or moisture that are a byproduct of the cooking operation. In short, the packaged food product includes a paperboard base attached (such as by lamination) to a metalized susceptor material and an integrated absorbent material. The combination of these elements is ideally configured to balance the removal of grease from the food-contacting surface of the susceptor while providing sufficient oil or grease, e.g., a minimal amount of grease thereon to permit proper crisping of the food product. The packages herein may be particularly attractive to consumers who wish to enjoy fried bacon (or other food products which may produce oil or grease during the cooking process, such as, for example, sausage, cold cuts, or deli meats), but want to avoid the mess and smell associated with frying such items or want to enjoy a single serving of such a food product.

FIG. 1 illustrates a microwavable packaged food product 10 having raw meat 12, such as raw bacon, thereon. In addition to raw bacon 12, the packaged food product may include, for example, meatballs, chips, baked goods, vegetable pieces or slices, processed foods, and/or other meats, along with raw, previously—or partially—cooked foods, among other options. As shown, the packaged food product 10 includes multilayer microwavable tray or support 14 having a top support surface 16 and a lower support surface 18 connected by side support walls 20. In between the top and lower support surfaces 16, 18, the microwavable support 14 has an absorbent pad 22 that is configured to absorb grease and/or moisture from the raw meat 12 or other food product during microwave cooking.

To cook, heat, crisp, and/or brown the food product 12, the microwavable support 14 has a susceptor layer 24. In one configuration, the susceptor layer 24 having a microwave energy interactive material is disposed on the top support surface 16. Further, as illustrated, the susceptor layer 24 has a plurality of discrete openings 26 disposed therein. By one approach, the plurality of discrete openings 26 extend through the susceptor layer 24 and the top support surface 16 such that moisture and grease are permitted to drain or move therethrough. Further, the absorbent pad layer 22 disposed in between the top and lower support surfaces 16, 18 may absorb at least some of the moisture and grease separated from the bacon 12 during the cooking process in the microwave oven. In one configuration, the absorbent pad layer 22 (which is underneath the top support surface 16) has a flexible paper-based material suitable for absorbing moisture and grease, which may be flow through the discrete openings 26 in the susceptor layer 24 and the top support surface 16.

In one configuration, the top support surface 16 has an angled configuration. In one configuration, at least some of the plurality of discrete openings 26 are disposed in a valley 30 of the angled, top support surface 16. In some embodiments, the susceptor layer 24 is a multilayer flexible structure having at least a top product-contacting layer with a metallized material having the microwave energy interactive material thereon and a paper layer. Further, in one approach, the angled, top support surface 16 has a v-shape configuration with a centrally disposed lowermost drain 28.

In some embodiments, the plurality of discrete openings 26 are disposed primarily along the valley of the angled, top support surface 16. In other configurations, some of the discrete openings may be disposed at other locations on the susceptor layer 24 and the top support surface 16. As discussed in more detail below, a variety of configurations may be employed. For example, the discrete openings may be disposed at a higher concentration at a center of the microwavable support surface or tray. In one illustrative approach, the plurality of discrete openings are disposed in a radial configuration (which also may include a higher concentration of openings at a center of the microwavable support).

Figure 2:
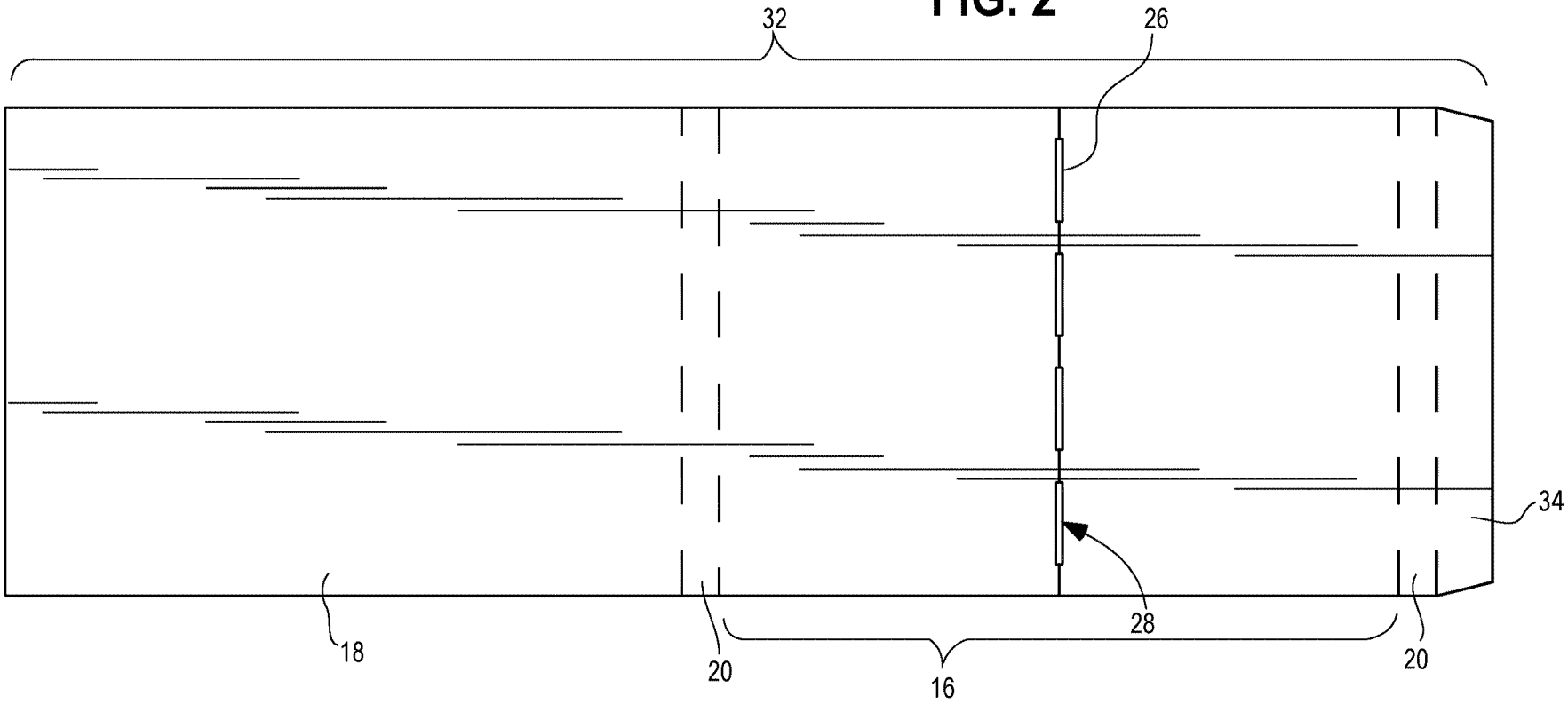
FIG. 2 is a top view of a portion of the package of FIG. 1 in a flat configuration.

By one approach, the top support surface 16, lower support surface 18, and side support walls 20 are comprised of a paperboard material. FIG. 2 illustrates a paperboard blank 32 usable for forming the portion of the microwavable support surface 14 made of paperboard. The paperboard blank 32 includes the top support surface 16, the side walls 20, and the lower support surface 18. In addition, the top support surface 16 has a plurality of discrete openings 26 disposed therein. As noted above, the discrete openings 26 are also disposed in the susceptor layer 24 (in a manner such that the discrete openings in the susceptor layer and the discrete opening sin the top surface 16 align with one another to facilitate efficient draining of the grease and moisture from the product-contacting surface of the susceptor layer 24). While the discrete openings 26 extend through the top support surface 16, in other configurations discussed below, the support surface or tray may not have any openings in the paperboard layer. FIG. 2 also illustrates a tongue or extension piece 34 extending from the support surface 16 (which also may extend from the lower support surface 18) that may be affixed to the lower support surface 18 (or the top support surface 16). In one illustrative approach, the extension 34 may be affixed to the other end of the paperboard blank 32 before or after the susceptor layer 24 and/or the absorbent pad 22 are affixed thereto.

Figure 3:
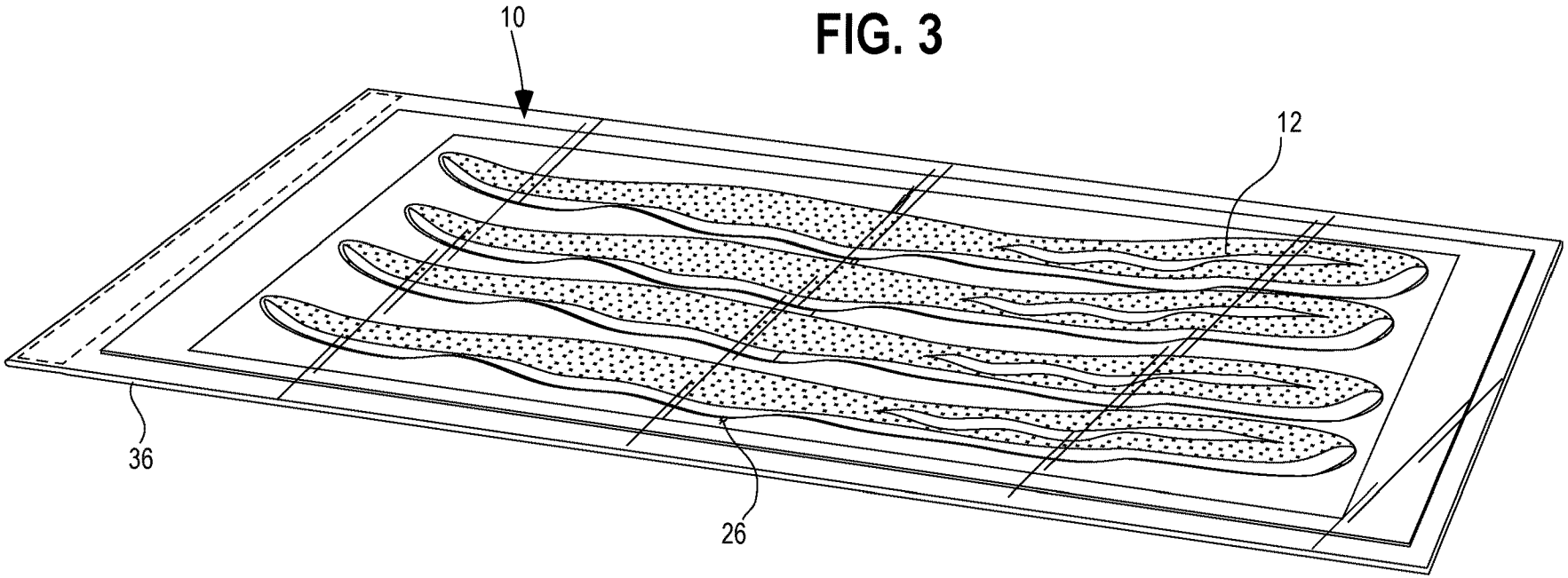
FIG. 3 is a top perspective view of the package of FIG. 1 in an unopened configuration.

Once the susceptor layer 24 and the absorbent pad 22 are affixed to the paperboard blank 32 and the extension 34 affixed to a reminder of the blank 32, the microwavable packaged food product 10 may have the raw bacon 12 placed thereon and then wrapped, vacuum packed and/or sealed within a film 36, such as an ethylene vinyl alcohol barrier film. In one illustrative approach, the paperboard blank 32 is placed in the film wrapper 36 (see, e.g., FIG. 3) in a generally flat configuration such that when the consumer removes the microwavable packaged food product 10 from the film 36, the consumer reconfigures the paperboard blank 32 from the flat transport or shipping configuration to the configuration of FIG. 1 having an angled top support surface 16 and side walls 20 generally vertical and generally perpendicular to the lower support surface 18.

In operation, the consumer may open the pouch or film 36 by tearing open the vacuum packed container, removing the packaged food product 10 from the film 36 (which helps prevent the food product from being steamed in the pouch, which can result in a chewy food product), erecting the multilayer microwavable support 14 (if necessary), and optionally placing a paper towel over the top of the packaged food product 10 in the microwave oven to prevent grease splatter before microwaving the raw bacon for about 2 to about 5 minutes. This permits the consumer to cook raw bacon into a crispy, cooked bacon in minutes without the chewy mouthfeel usually associated with microwaved bacon. This occurs by having the absorbent pad 22 pull the grease and moisture from the surface of the susceptor layer 24 in a relatively quick manner, though not too quickly such that a small amount of grease is retained thereon to provide the crispy, fried bacon appearance and mouthfeel (without shrinking the bacon significantly) that consumers typically enjoy. While some consumers may prefer to use a paper towel over the top of the packaged food product 10, by having the absorbent pad 22 removing grease at a relatively quick pace, there is typically less grease to splatter within the microwave than consumers generally encounter when microwaving bacon in a microwave oven in an uncontained capacity. A paper towel may be included as part of the packaged food product.

Figure 4:
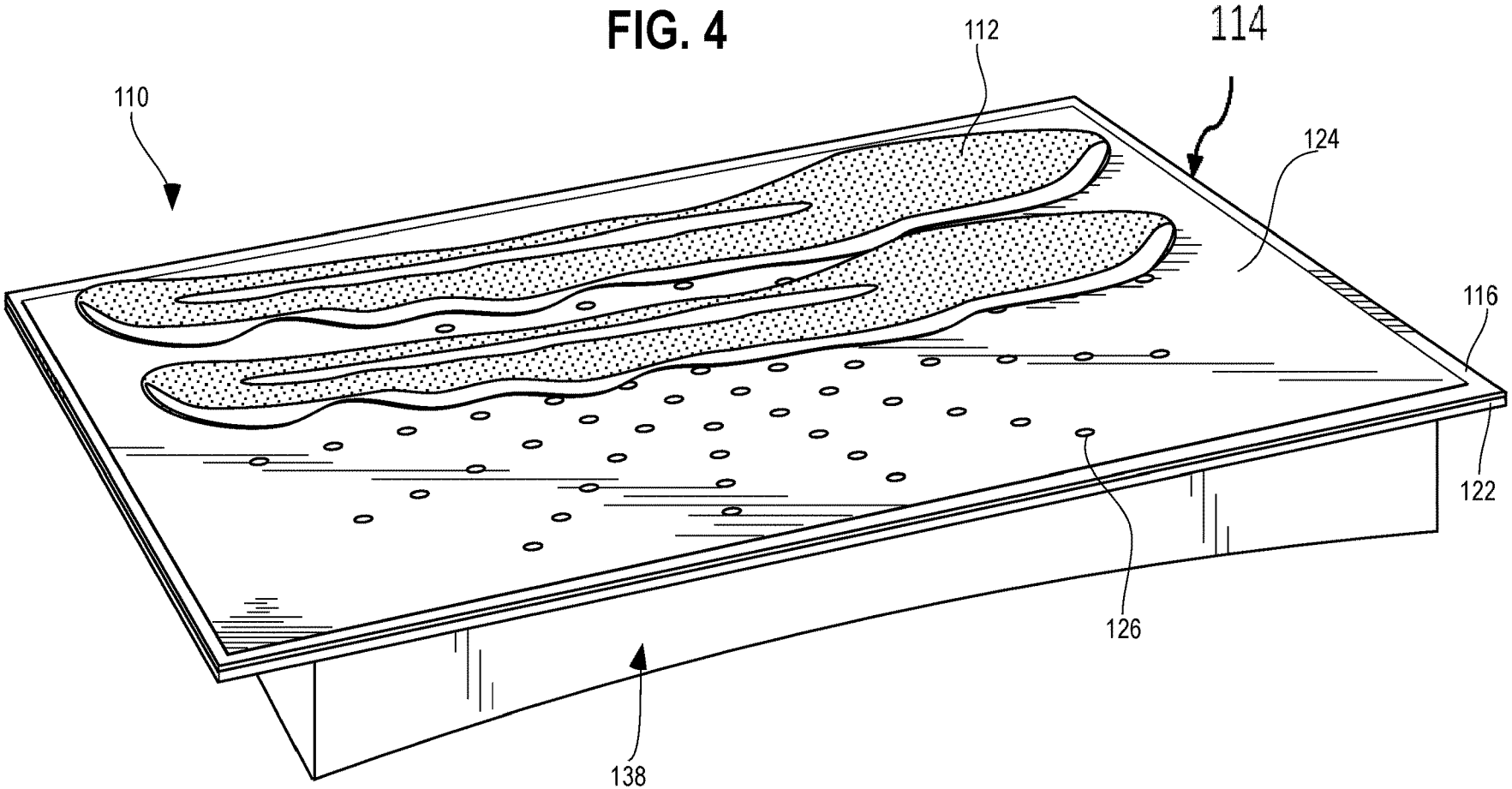
FIG. 4 is a top perspective view of another food package in accordance with several embodiments.

FIG. 4 illustrates another microwavable packaged food product 110 with a food product 112, such as raw bacon, thereon. Whereas some of the earlier figures included an angled food-supporting surface, FIG. 4 illustrates a generally flat, microwavable tray or support. In this configuration, the microwavable packaged food product 110 includes an outer package, such as a film wrapper and/or box (not shown) and a quantity of food product 112 contained therein. The package food product 112 is configured to be heated in a microwave oven and the package facilitates heating of the food product thereon. In some embodiments, a flat, multilayer microwavable support 114 has at least three layers including a susceptor layer 124, an absorbent pad 112, and a paperboard base layer 116. The packaged food product 110 also may include an optional stand 138 in some configurations. In one illustrative configuration, the microwavable support has an overall support width of about 9.0-in., an overall support length of about 6.5-in., and a support thickness of between about 0.03-in. to about 0.070-in.

By one approach, the susceptor layer 124 has a microwave interactive material thereon and a plurality of discrete openings 126 disposed therein. As discussed below, the susceptor layer 124 may have more than one layer therein. The susceptor layer 124 generally has a plurality of discrete openings 126 disposed therein. In one exemplary approach, the plurality of discrete openings 126 are disposed in a configuration such that a center of the microwavable support or tray has a higher concentration of the discrete openings 126.

As suggested above, the susceptor layer 124, like the microwavable support or tray 114, is a multilayer structure. By one approach, the susceptor layer 124 is a multilayer flexible structure having at least a top product-contacting layer with a metalized material having the microwave energy interactive material thereon and a paper layer. By another approach, the multilayer flexible structure of the susceptor layer 124 further includes an additional polymer layer. Generally, the paper layer of the susceptor layer 124 is not exposed such that there is minimal grease and/or moisture absorption by the paper layer. For example, in some configurations the paper layer of the susceptor layer 124 is embedded and not exposed. In one configuration, the susceptor layer 124 has a susceptor thickness of between about 0.002-in. to about 0.020-in.

In one configuration, the microwavable support 114 has a top surface area of about 50-in.$^2$ to about 80-in.$^2$. By one configuration, the discrete openings having a higher concentration at a center of the microwavable tray have a radial configuration. In some embodiments, the susceptor layer 124 has between about 30 to about 80 discrete openings 126 therein. Further, in some configurations, each of the discrete openings 126 has a diameter of between about 0.125-in. to about 0.25-in. By one approach, the microwavable support has a ratio of susceptor layer area to area of openings of between about 40:1 to about 80:1.

In another aspect, the absorbent pad layer 122 includes a flexible paper-based material suitable for absorbing moisture and grease. Similar to the susceptor layer 124, the absorbent pad layer 122 also may be a multilayer flexible structure. By one approach, the absorbent pad has a paper layer, a clear polyethylene layer, and a non-woven paper-based layer for moisture and grease absorption. In some embodiments, the absorbent pad layer 122 has a pad thickness of between about 0.010-in. to about 0.040-in. and a basis weight of about 135 lbs./ream (1,000 sq. feet.).

In yet another aspect, the paperboard base layer 116 supports the susceptor layer 124 and the absorbent pad layer 122. As noted above, the paperboard base layer 116 may be a single layer and may have a base thickness of between about 0.010-in. to about 0.030-in.

Figure 5:
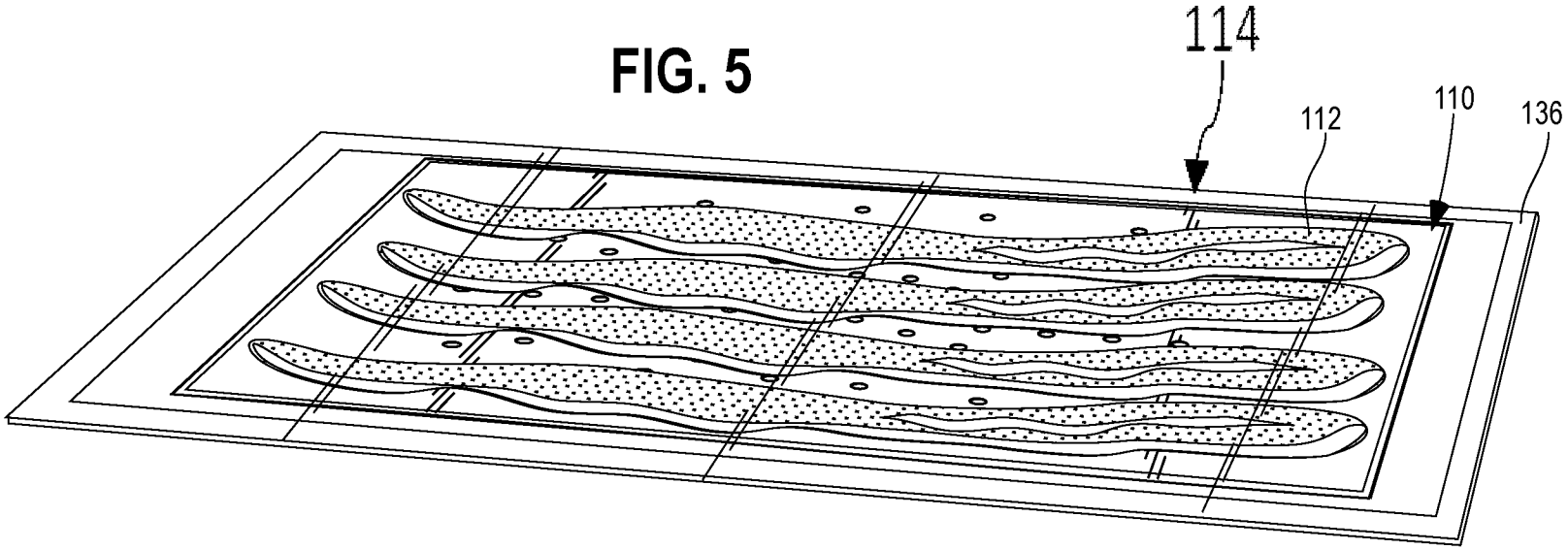
FIG. 5 is a top perspective view of a portion of FIG. 4 in an unopened configuration.
Figure 6:
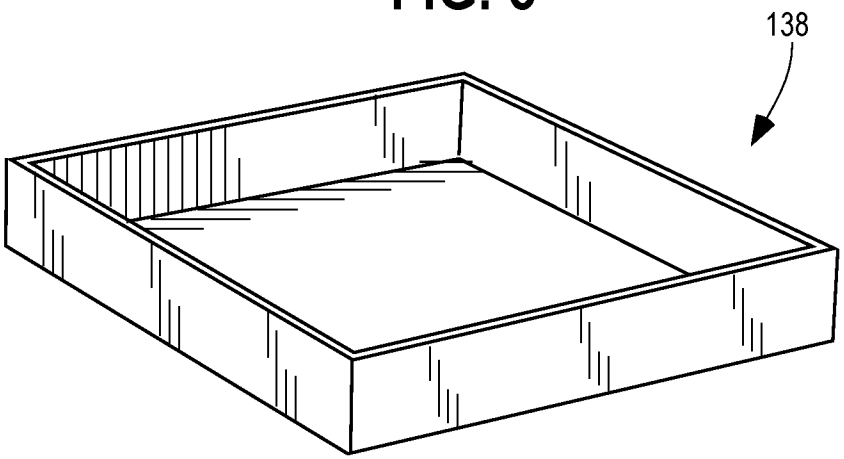
FIG. 6 is a top perspective view of a portion of FIG. 4.

As shown in FIG. 4, the microwavable food product 110 may have a stand 138 that elevates a flat, microwavable support 114 from a floor or lower point of the microwave oven. As shown in FIG. 6, the package may include a rectangular stand, which may be, for example, self-erecting, which is configured to elevate the microwavable support 114. If a stand 138 is included in the food package, the stand 138 is generally outside of the vacuum packed container with the food product 112 to reduce the amount of air in the package or the stand 138 is included in a flat configuration. FIG. 5 illustrates the flat, microwavable support 114 and the food product 112 disposed in a film wrapper 136. Though FIG. 5 illustrates the film wrapper 136 having four side seals, a number of film wrappers could be used to ship the food product 112 and retain the freshness thereof.

Figure 7:
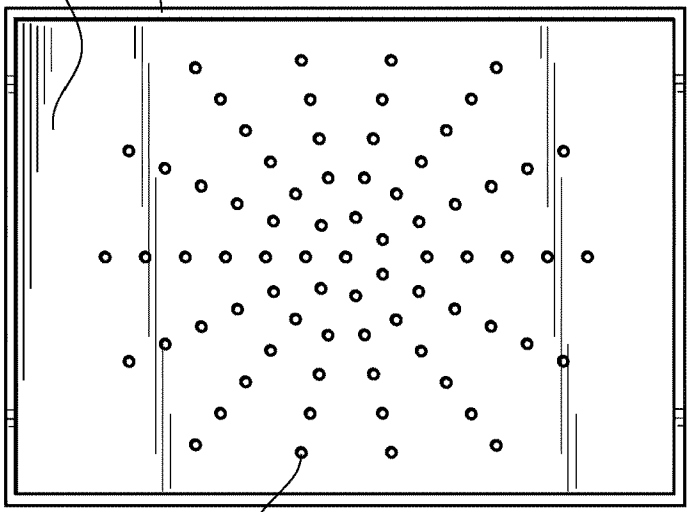
FIG. 7 is a top view of a portion of FIG. 4.

In some embodiments, the susceptor layer 124, the absorbent pad layer 122, and the paperboard base layer 116 are not coextensive with one another. For example, the susceptor layer 124, in some configurations, covers less surface area of the microwavable support 114 than the paperboard base layer 116. FIG. 7 illustrates a susceptor layer 124 that covers less than an entire surface of the microwavable support 114. For example, a perimeter edge of the susceptor layer 124 does not extend to a perimeter edge of the microwavable support 114 or the paperboard base layer 116. By one approach, the susceptor layer covers between about 40% to about 60% of an entire support surface area. While the absorbent pad 122 may be only disposed underneath the discrete openings 126 or the susceptor layer 124, in some configurations, the absorbent pad 122 is coextensive with the paperboard layer 116, even if the susceptor layer 124 covers less than an entire support surface area. In other embodiments, the susceptor layer, the absorbent pad layer, and the paperboard base layer are coextensive with one another.

Figure 8:
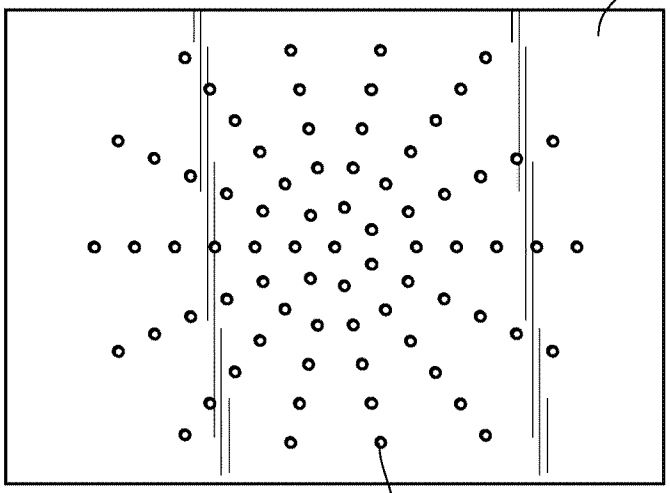
FIG. 8 is a top view of another food package in accordance with several embodiments.
Figure 9:
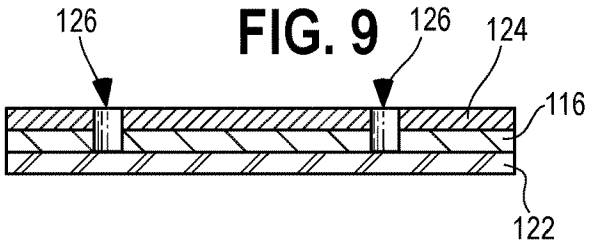
FIG. 9 is a cross sectional view of a portion of FIG. 8.

FIG. 8 illustrates a top view of one embodiment, having the susceptor layer 124, the absorbent pad layer 122, and the paperboard base layer 116 coextensive with one another in the length and width thereof. Though the susceptor layer 124 is primarily visible from the top view, the discrete openings 126 in the susceptor layer 124 permit access to the absorbent pad 122 therebelow. As shown in the cross section of FIG. 9, the paperboard base layer 116 is sandwiched between the susceptor layer 124 and the absorbent pad 122 in this configuration. Accordingly, the discrete openings 126 extend through the susceptor layer 124 and the paperboard base layer 116 through to the absorbent pad 122. Though the paperboard base layer 116 may absorb very small quantities of grease and moisture, the absorbent pad 122 absorbs sufficient grease and moisture to permit the bacon product to cook and crisp during the microwave cooking operation without getting chewy. Further, the perforation pattern of discrete openings in the susceptor layer retains sufficient grease thereon to crisp the food product such as bacon without shrinking the food product too greatly (which can happen if the susceptor layer does not have sufficient grease disposed thereon during the cooking operation).

Figure 10:
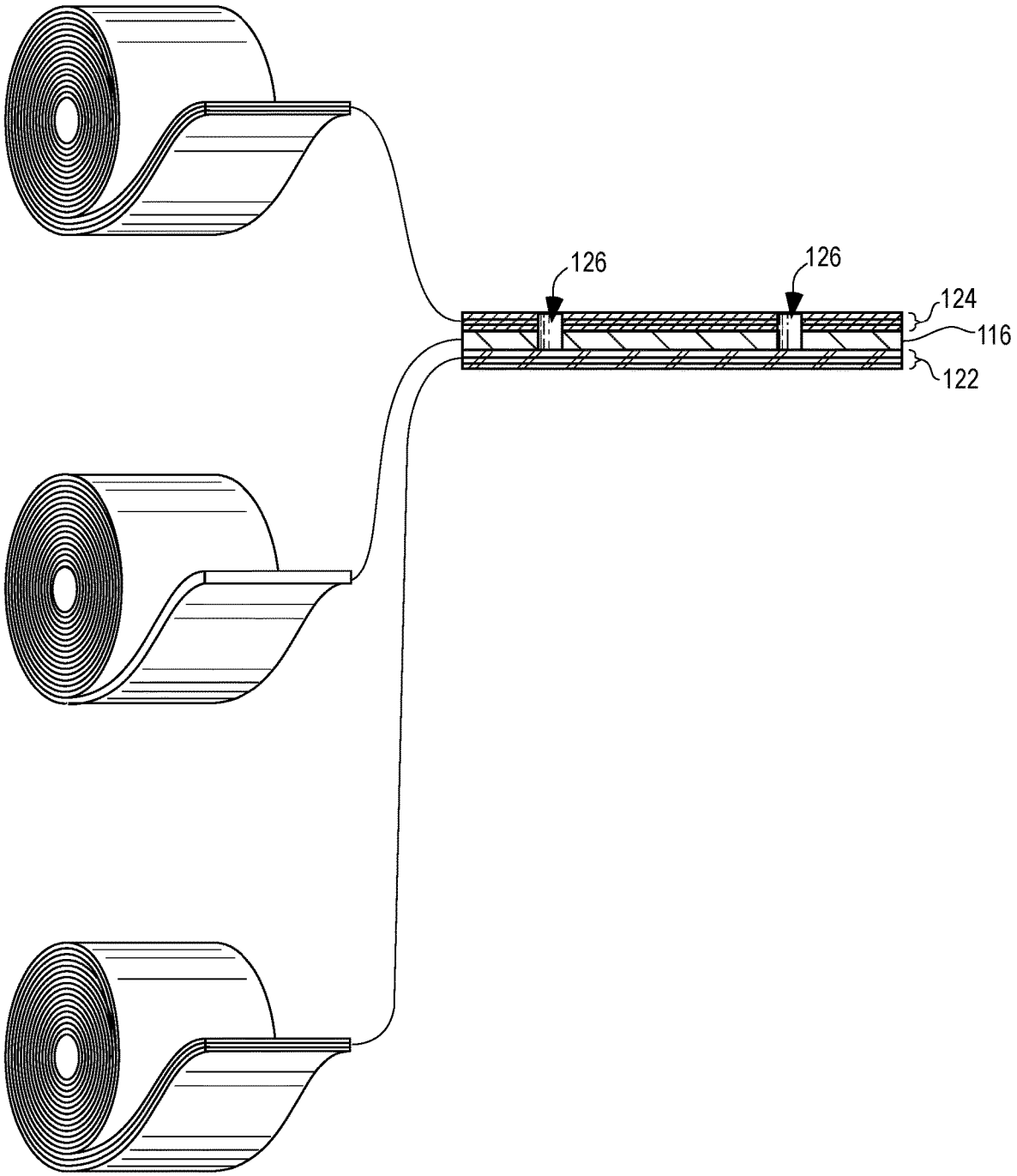
FIG. 10 is a schematic and cross sectional view illustrating additional details of the layers of FIG. 9.

FIG. 10 illustrates a schematic illustration showing the various multilayer layers of one embodiment of the microwavable support 114. In some embodiments, the susceptor layer 124 may include, for example, a metalized material, a paper layer and/or a polymer layer and the absorbent pad layer 122 may include, for example, a paper layer, a polyethylene layer, and a non-woven paper-based layer for moisture and grease absorption. To illustrate the combination of layers, FIG. 10 shows how rolls of the different materials (i.e., the three macro layers) may be combined to create the microwavable support 114. These three layers may be attached together with, for example, heat, pressure, glue or adhesive bonding, or a combination thereof. Further, as noted above, the order of the layers may vary.

Figure 11:
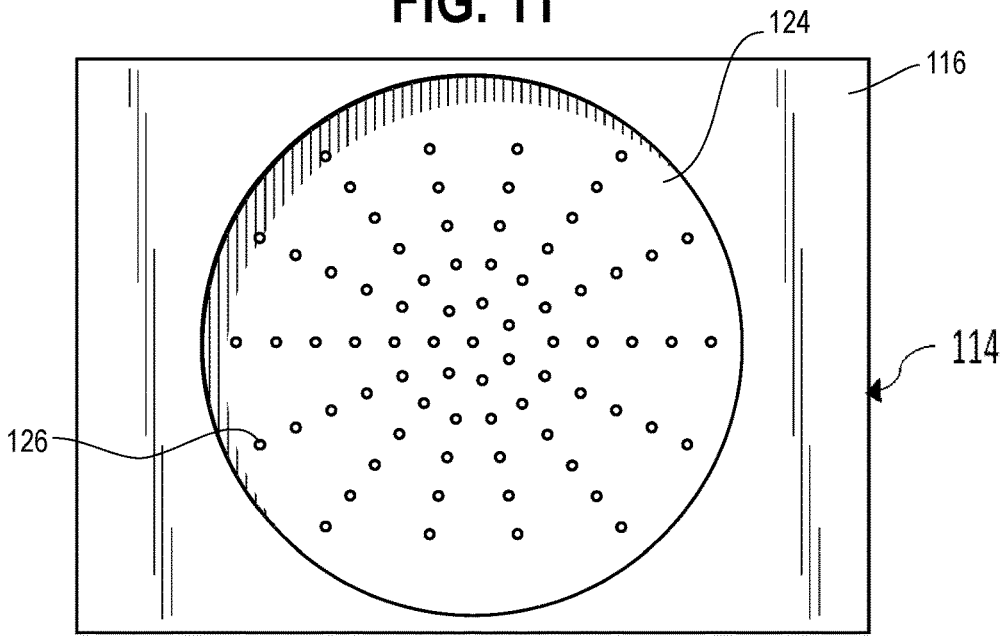
FIG. 11 is a top view of another food package in accordance with several embodiments.

Another configuration having non-coextensive layers is shown in FIG. 11. In this configuration, the susceptor layer 124 covers less surface area of the microwavable support 114 than the paperboard base layer 116. Further, the susceptor layer 124 has a generally circular configuration that is generally disposed in a center of the microwavable support 114. Further, the discrete openings in the radial configuration are centrally disposed on the susceptor layer 124. By one approach, the paperboard base layer 116 extends beyond the perimeter of the susceptor layer 124 such that a consumer can grasp the paperboard base layer 124 without touching the susceptor layer 124, which may be hot after the microwave cooking operation.

As shown in FIGS. 7, 8, and 11, the susceptor layer 124 may have a pattern of radially disposed discrete openings 126 disposed therein. While the discrete openings illustrated in those figures have a generally circular configuration, other configurations are possible. For example, the discrete openings may be rectangular, oval-shaped, or diamond-shaped, among others.

Figure 12:
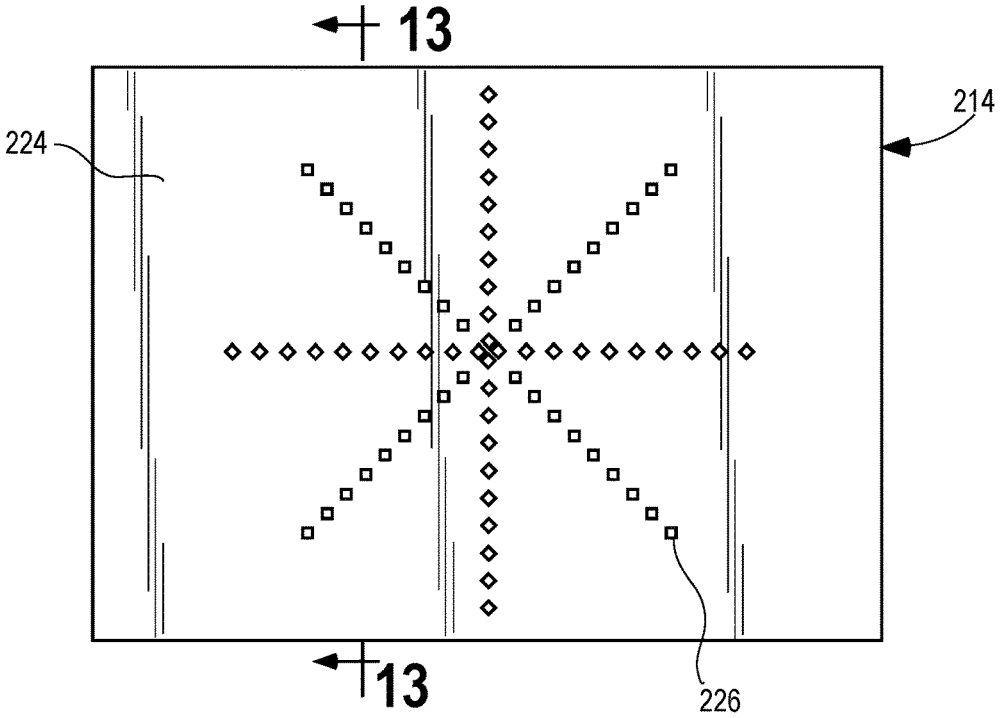
FIG. 12 is a top view of another food package in accordance with several embodiments.
Figure 13:
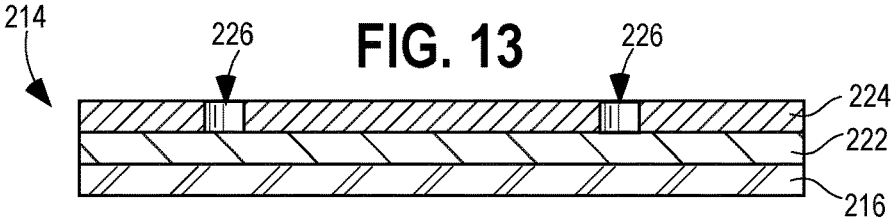
FIG. 13 is a cross sectional view of a portion of FIG. 12.
Figure 14:
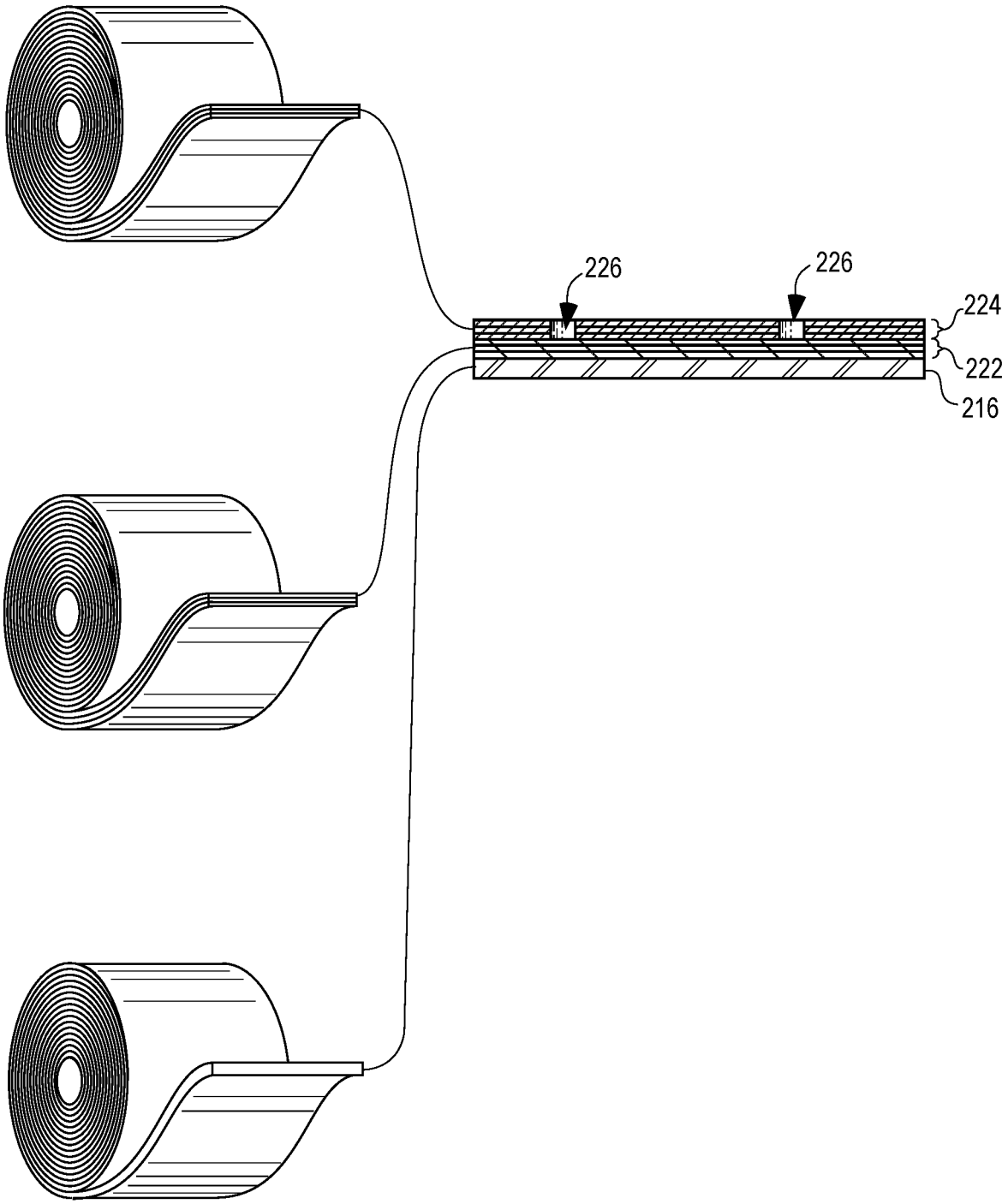
FIG. 14 is a schematic and cross sectional view illustrating additional details of the layers of FIG. 13.

FIG. 12 illustrates a microwavable support 214 with a susceptor layer 224 having discrete openings 226 therein. FIG. 12 illustrates a slightly different radial pattern, as compared with previous figures and includes diamond-shaped discrete openings 226. The cross section of FIG. 13 illustrates the microwavable support 214 having the absorbent pad 222 sandwiched between the food-contacting susceptor layer 224 and the paperboard base layer 216. Accordingly, the discrete openings 226 extend only through the susceptor layer 226 and not through the middle, absorbent pad layer 222. FIG. 14 illustrates the combination of the three layers with the susceptor layer 226 and the absorbent pad layer 222, each having multiple layers therein.

In some embodiments, the discrete opening in the susceptor layer (and the paperboard layer in some embodiments), may be formed via, for example, die cuts or laser cuts formed in the susceptor layer (and optionally the paperboard layer). In one illustrative approach, the discrete openings are cut into the material before the susceptor layer is attached to the absorbent pad.

The microwavable tray or support may be formed by laminating the three macro layers (i.e., the susceptor layer, the absorbent pad, and the paperboard base) together. When forming a microwavable tray or support with generally coextensive layers, the three layers may be generally continuously or intermittently unspooled from rolls and laminated (or otherwise attached) together. In another configuration, such as when the susceptor is inset on the paperboard base layer, a discrete susceptor may be cut from a roll of susceptor film and then applied, such as by adhesive, or otherwise laminated, to the paperboard base and/or absorbent pad after registration therewith. In some configurations, the susceptor layer and the absorbent pad are laminated together, cut from a roll, registered with the paperboard base and then adhered thereto.

By one approach, the three macro-layers (i.e., the absorbent pad, the susceptor, and the paperboard base) may be laminated together at roughly the same time. For example, as suggested above, rolls of the three macro-layers may be unwound and laminated together shortly thereafter. In yet another configuration, the application or lamination of the macro-layers may be staged. By one example, the susceptor layer may be applied to the paperboard base and the absorbent pad may be subsequently attached thereto. For example, the susceptor layer and the paperboard base may be attached and the discrete openings die cut therein before the absorbent pad is attached thereto.

Figure 15:
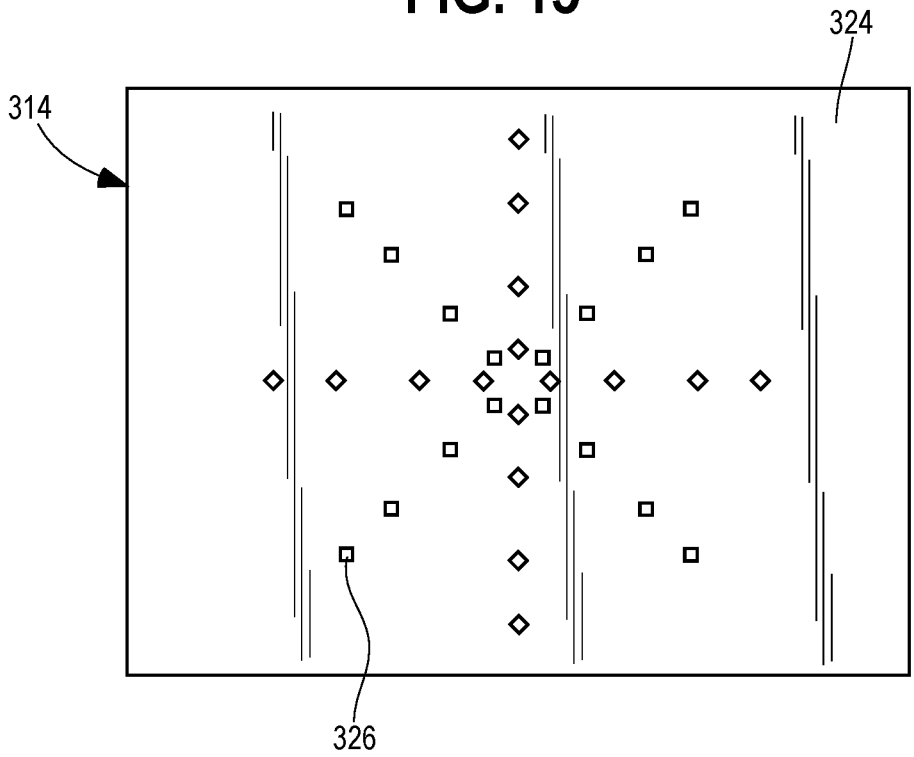
FIG. 15 is a top view of another food package in accordance with several embodiments.
Figure 16:
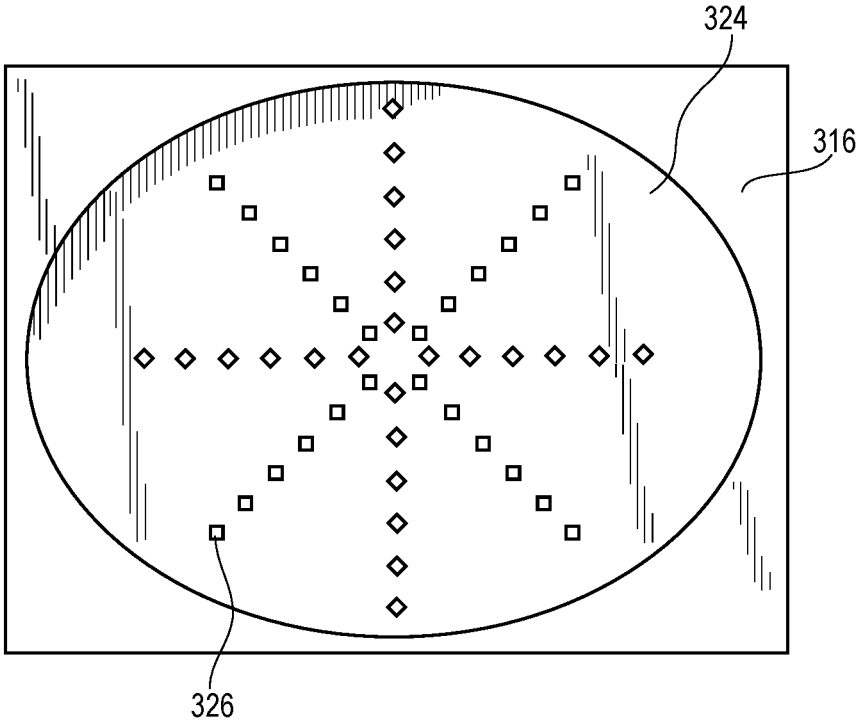
FIG. 16 is a top view of another food package in accordance with several embodiments.

FIG. 15 illustrates another radial configuration of discrete openings 326 in a susceptor layer 324 of microwavable support 314. Further, the diamond-shaped discrete openings 326 shown in FIG. 16 are disposed through an oval-shaped susceptor layer 324. In additional to oval- and circular-shaped susceptor layers, a discrete susceptor layer may be square-shaped, diamond-shaped, star-shaped, or another shape, though the susceptor layer is generally centrally located on the microwavable support or tray.

Figure 17:
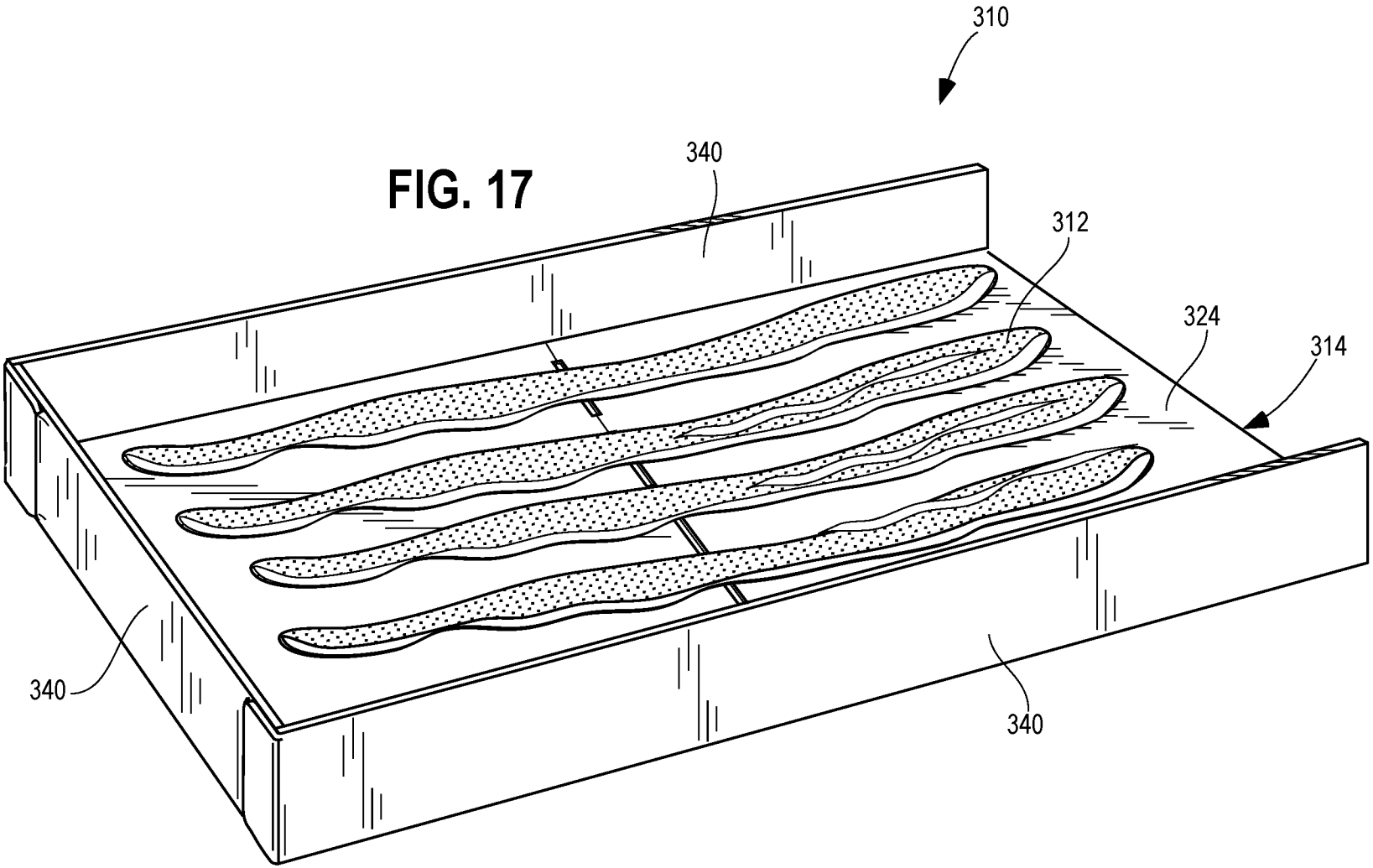
FIG. 17 is a top perspective view of another food package in accordance with several embodiments.
Figure 18:
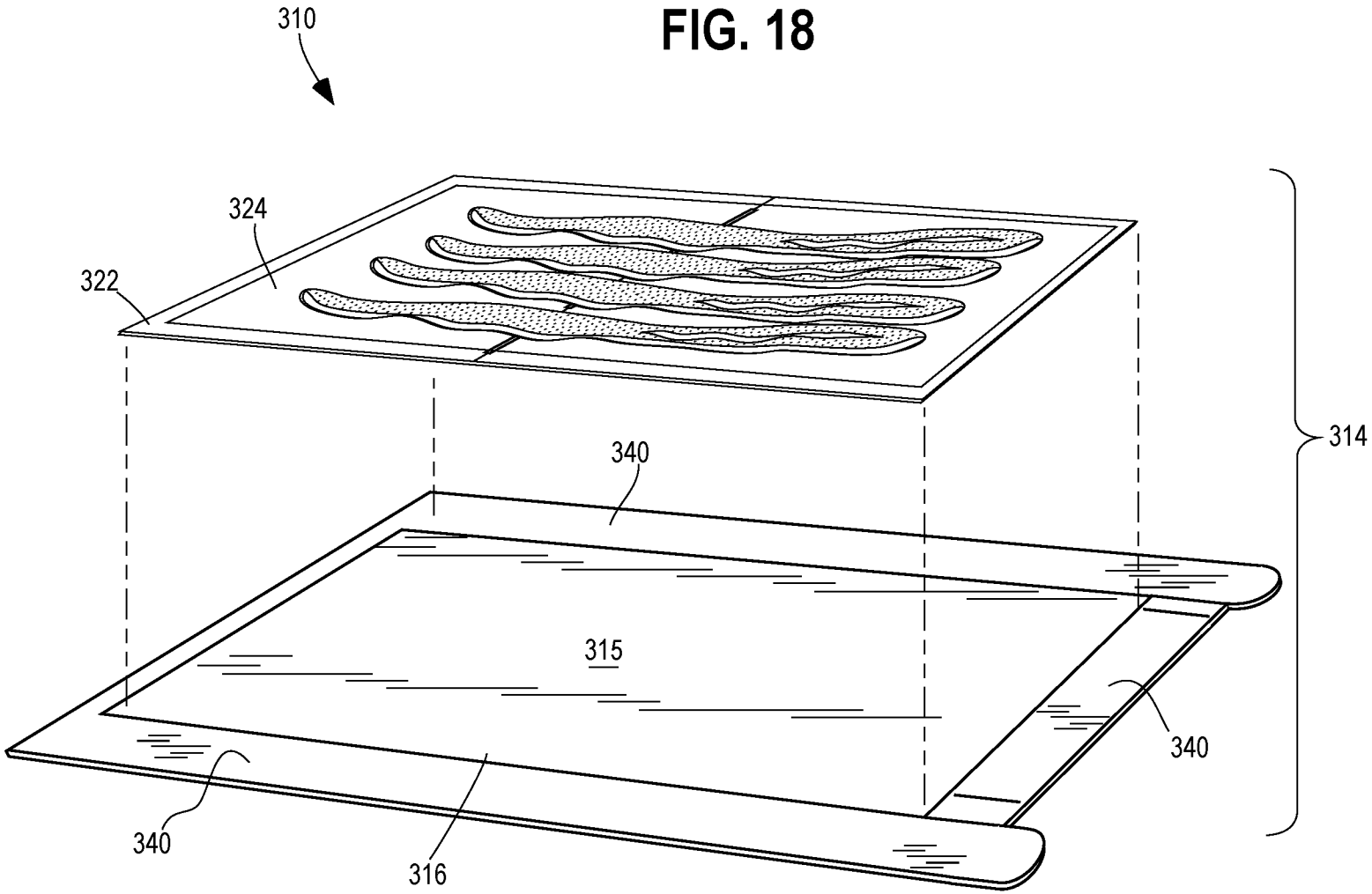
FIG. 18 is a top perspective view of a portion of FIG. 17.

FIG. 17 illustrates yet another embodiment of a microwavable packaged food product 310 with raw bacon 312 disposed thereon. The product 310 includes a multilayer microwavable support 314 with a susceptor 324, an absorbent pad 322, and a paperboard base layer 316. The paperboard base layer 316 may have one or more upstanding flanges 340 disposed at edges of the microwavable support 314. As shown in FIG. 18, the paperboard base layer 316 may have a central section 315 below the absorbent pad layer 322 and the susceptor layer 324 and wings or flanges 340 that may be shipped to the consumer in a flat configuration, but are movable into an erect or elevated configuration, generally perpendicular to the central portion 315 of the paperboard base layer 316. When in the cooking configuration of FIG. 17, the flanges 340 of the paperboard base layer 316 help retain the grease that may splatter during the microwave cooking operation and provide the consumer with an easily graspable paperboard section to remove the package from the microwave oven. Though FIG. 17 includes flanges 340 on three sides of the package, the flanges may only be disposed on two sides thereof.

EXAMPLES

The Examples herein are included to illustrate the disclosure herein and not to limit it. These examples aim to illustrate the difference between more conventional packages and those with some of the features described herein. For example, to quantify the absorption capabilities of the microwavable tray or support with an absorbent pad (identified as a package test in the table below) as compared to stock susceptor material (identified as the control in the table below), four strips of bacon were microwaved and the various elements of the package were weighed before and after the microwave cooking operation. The test package of the example below includes a microwavable support with a susceptor layer, a paperboard base, and an absorbent pad similar to that illustrated in FIG. 8. The control package, however, merely has a susceptor layer without any discrete openings therein and a paperboard base.

More particularly, the absorbent pad (in the package test) was weighed, the susceptor card (i.e., the susceptor layer and the paperboard base) for both the package test and the control material were weighed, the four raw bacon strips were weighed before being placed onto the prototypes and microwaved for 2.5 minutes in a 1100 W microwave. Upon removal of the prototypes from the microwave oven, the cooked bacon was weighed, the grease and moisture was poured off the tray and weighed, the susceptor tray was weighed, and the absorbent pad (present in the package test was weighed). All of the data below was collected in grams.

TABLE 1 lists the results of the measurements listed above

| | Sample | A Absorbent Pad Weight - Dry (g) | B Susceptor Card Weight (g) - Dry | C Raw Bacon Weight (g) | D Absorbent Pad Weight - with grease (g) | E Grease Poured Off (g) | F Susceptor Card Weight (g) - with grease | G Cooked Bacon Weight (g) |
|---|---|---|---|---|---|---|---|---|
| CONTROL | 1 | N/A | 18.20 | 74.40 | N/A | 7.37 | 21.20 | 26.00 |
| | 2 | | 17.80 | 78.40 | | 13.90 | 22.40 | 27.90 |
| | 3 | | 17.50 | 86.60 | | 16.04 | 21.40 | 25.20 |
| | 4 | | 17.40 | 86.90 | | 12.73 | 21.90 | 37.60 |
| | 5 | | 17.50 | 84.00 | | 7.83 | 22.50 | 41.40 |
| | | | | | Avg --> | 11.57 | | |

| | Sample | Absorbent Pad Weight - Dry (g) | Susceptor Card Weight (g) -Dry | Raw Bacon Weight (g) | Absorbent Pad Weight - with grease (g) | Grease Poured Off (g) | Susceptor Card Weight (g) - with grease | Cooked Bacon Weight (g) |
|---|---|---|---|---|---|---|---|---|
| TEST PACKAGE | 1 | 8.00 | 17.70 | 83.10 | 15.60 | 0.31 | 22.90 | 39.50 |
| | 2 | 8.00 | 18.70 | 90.10 | 16.30 | 0.47 | 24.10 | 44.90 |
| | 3 | 8.10 | 18.60 | 88.50 | 15.40 | 0.52 | 23.30 | 43.60 |
| | 4 | 8.10 | 20.10 | 78.20 | 10.80 | 0.37 | 23.90 | 40.90 |
| | 5 | 8.00 | 18.80 | 70.40 | 10.60 | 0.20 | 21.90 | 33.50 |
| | | | | | Avg --> | 0.37 | | |

TABLE 2 analyzes the weights gathered in columns A through G listed above.

| | Sample | 1 Total Amount of Grease (g) | 2 Amount absorbed by Susceptor Card (g) | 3 Amount absorbed by pad | 4 Amount NOT absorbed (g) | 5 % of Loose Grease NOT Absorbed |
|---|---|---|---|---|---|---|
| CONTROL | 1 | 10.37 | 3.00 | N/A | 7.37 | 71.07 |
| | 2 | 18.50 | 4.60 | | 13.90 | 75.14 |
| | 3 | 19.94 | 3.90 | | 16.04 | 80.44 |
| | 4 | 17.23 | 4.50 | | 12.73 | 73.88 |
| | 5 | 12.83 | 5.00 | | 7.83 | 61.03 |
| | | | | | Avg --> | 72.31 |

| | Sample | Total Amount of Grease (g) | Amount absorbed by Susceptor Card (g) | Amount absorbed by pad (g) | Amount NOT absorbed (g) | % of Loose Grease NOT Absorbed |
|---|---|---|---|---|---|---|
| TEST package | 1 | 13.11 | 5.20 | 7.60 | 0.31 | 2.36 |
| | 2 | 14.17 | 5.40 | 8.30 | 0.47 | 3.32 |
| | 3 | 12.52 | 4.70 | 7.30 | 0.52 | 4.15 |
| | 4 | 6.87 | 3.80 | 2.70 | 0.37 | 5.39 |
| | 5 | 5.90 | 3.10 | 2.60 | 0.20 | 3.39 |
| | | | Avg --> | 3.72 | | |

The total amount of grease listed in column 1 is the difference in the weights of the components i.e., the susceptor tray and pad (if present) before and after cooking plus the weight of the grease poured off. Further, column 4 illustrates the total amount of grease not absorbed, i.e., the total amount of grease in column 1 minus the mount of grease absorbed by the component(s) i.e., the susceptor tray and the absorbent pad in the test package. Finally, column 5 shows the percentage of grease not absorbed, i.e. column 4 divided by column 1. This illustrates that the susceptor tray with the absorbent pad is much more efficient at absorbing grease as compared to a stock susceptor material without the absorbent pad.

The bacon used in the above test included center cut bacon with a moisture content of about 35.25% to about 62.75%, a protein content of about 7.5% to about 18.5%, a fat percentage of about 16.25% to about 52.25%, and a salt content of about 1.16% to about 2.16%. In another bacon product, the bacon has a moisture content of about 30.75% to about 58.25%, a protein content of about 7.5% to about 17.75%, a fat percentage of about 22.5% to about 57.5%, and a salt content of about 1.16% to about 2.16%. In another product, the bacon has a moisture content of about 30.75% to about 58.25%, a protein content of about 7.5% to about 17.75%, a fat percentage of about 22.5% to about 57.5%, and a salt content of about 0.95% to about 1.95%. In some embodiments, the bacon may have a protein content above 18.5%. Though these examples illustrate a few of the bacon products that could be booked using the packages described herein, other foods (including raw, pre-cooked, or partially-cooked items) may have content ranges outside of these provided.

Those skilled in the art will recognize that a wide variety of other modifications, alterations, and combinations can also be made with respect to the above described embodiments without departing from the scope of the invention, and that such modifications, alterations, and combinations are to be viewed as being within the ambit of the inventive concept.

What is claimed is:

1. A microwavable packaged food product comprising an outer package and a quantity of food product contained therein, the packaged food product being configured to be heated in a microwave oven and comprising:

a multilayer microwavable support having at least three layers including:

a susceptor layer including a microwave energy interactive material and a plurality of discrete openings disposed therein, the discrete openings are disposed in a higher concentration at a center of the microwavable support;

an absorbent pad layer having a flexible paper-based material suitable for absorbing moisture and grease; and a paperboard base layer having an upper support, a lower support, and side support walls connecting the upper support and lower support, the susceptor layer disposed on the upper support and the absorbent pad layer disposed on the lower support, the absorbent pad layer being between the upper support and the lower support, wherein the microwaveable support is reconfigurable from a first transport configuration to a second cooking configuration by shifting the upper support relative to the lower support, wherein in the first transport configuration a first portion and a second portion of the susceptor layer and the upper support at the center of the microwaveable support are substantially planar, and wherein in the second cooking configuration the upper support and lower support are at least spaced from one another at the side support walls and the first portion and the second portion of the susceptor layer and the upper support at the center of the microwavable support extend at an oblique angle relative to one another to form an angled, upwardly facing surface to support the food product and to direct grease toward the discrete openings as the packaged food product is heated, the upper support at the center of the microwaveable support resting on the absorbent pad layer of the lower support with the discrete openings extending through the upper support such that the absorbent pad layer draws moisture and grease from the upper support to the absorbent pad layer disposed on the lower support through the discrete openings.

2. The packaged food product of claim 1 wherein the susceptor layer is a multilayer flexible structure having at least a top product-contacting layer including a metallized material having the microwave energy interactive material and a paper layer.

3. The packaged food product of claim 2 wherein the multilayer flexible structure of the susceptor layer further includes an additional polymer layer and the multilayer flexible structure of the susceptor layer has a thickness of between about 0.002-in. to about 0.020-in.

4. The packaged food product of claim 1 wherein the microwavable support has a top surface area of about 50 to about 80 in.$^2$, and the discrete openings having a higher concentration at a center of the microwavable support are disposed in a radial configuration and include between about 30 and about 80 discrete openings, each having a diameter of between about 0.125-in. to about 0.25-in.

5. The packaged food product of claim 1 wherein the microwavable support has a ratio of a surface area of the susceptor layer to area of openings of between about 40:1 and about 80:1.

6. The packaged food product of claim 1 wherein the paperboard base layer has a base thickness of between about 0.010-in. and about 0.030-in.

7. The packaged food product of claim 1 wherein the absorbent pad layer is a multilayer flexible structure having a paper layer, a clear polyethylene layer, and a non-woven paper-based layer for moisture and grease absorption.

8. The packaged food product of claim 7 wherein the absorbent pad layer has a pad thickness of between about 0.010-in. and about 0.040-in. and has a basis weight of about 135 lbs./ream (1,000 sq. ft.).

9. The packaged food product of claim 1 wherein the microwavable support has an overall support width of about 9.0-in., an overall support length of about 6.5-in., and a support thickness of between about 0.03-in. to about 0.070-in.

10. The packaged food product of claim 1 wherein the susceptor layer, the absorbent pad layer, and the paperboard base layer are coextensive with one another.

11. The packaged food product of claim 1 wherein the susceptor layer covers less surface area of the microwavable support than the paperboard base layer.

12. The packaged food product of claim 11 wherein the susceptor layer covers between about 40% to about 60% of the upper support.

13. The packaged food product of claim 11 wherein the paperboard base layer of the microwavable support layer extends beyond a perimeter of the susceptor layer such that a consumer can grasp the paperboard base layer without touching the susceptor layer.

14. The packaged food product of claim 11 wherein the susceptor layer covers less surface area of the microwavable support than the paperboard base layer and the susceptor layer has a circular configuration generally disposed in a center area of the microwavable support.

15. The packaged food product of claim 1 further comprising:

a rectangular self-erecting stand configured to elevate the multilayer microwavable support from a floor of the microwave.

16. The packaged food product of claim 1 further comprising one or more upstanding flanges disposed at edges of the microwavable support.

17. The packaged food product of claim 1 wherein the paperboard base layer is under the absorbent pad layer such that grease on the susceptor layer drains through the discrete openings directly to the absorbent pad layer.

18. The packaged food product of claim 17 wherein the susceptor layer and the absorbent pad layer are laminated together.

19. The packaged food product of claim 1 wherein in the second cooking configuration the upwardly facing support surface of the upper support slopes toward at least some of the plurality of discrete openings.

20. The packaged food product of claim 1 wherein the microwavable support is configured to facilitate removal of at least 90% of the grease on the susceptor layer that is generating during microwaving to the absorbent pad.

21. The packaged food product of claim 1 wherein at least some of the plurality of discrete openings are disposed in a valley of the angled, upwardly facing surface.

22. A raw meat package configured to permit the raw meat to be cooked in a microwave, the package comprising:

a multilayer microwavable support having a top support surface and a lower support surface, the top support surface and lower support surface connected by side support walls, the multilayer microwavable support having an absorbent pad supported by the lower support surface and between the top and lower support surfaces, the top support surface, the lower support surface, and the side support walls being a paperboard material; and the top support surface having a susceptor layer disposed thereon, the susceptor layer including a microwave energy interactive material and a plurality of discrete openings disposed in the susceptor layer and the top support surface;

the top support surface having a flat transport configuration where a first portion and a second portion of the susceptor layer and the top support surface at a center of the microwaveable support are substantially planar; and the top support surface reconfigurable to an angled cooking configuration by shifting the top support surface relative to the lower support surface such that the top support surface and lower support surface are at least spaced apart from one another at the side support walls and the first portion and the second portion of the susceptor layer and the top support surface extend at an oblique angle relative to one another to form an angled, upwardly facing cooking surface to support a food product during cooking and to direct grease toward the plurality of discrete openings during microwave cooking, the top support surface at the center of the microwaveable support resting on the absorbent pad supported by the lower support surface with the plurality of discrete openings extending through the top support surface such that the absorbent pad draws moisture and grease from the top support surface to the absorbent pad supported by the lower support surface beneath the top support surface through the plurality of discrete openings;

the absorbent pad disposed on the lower support surface, the absorbent pad having a flexible paper-based material suitable for absorbing moisture and grease that drains through the openings in the susceptor layer to the absorbent pad on the lower support surface.

23. The package of claim 22 wherein the susceptor layer is a multilayer flexible structure having at least a top product-contacting layer with a metallized material including the microwave energy interactive material and a paper layer and the angled, top support surface having a v-shape with a centrally disposed lowermost drain.

24. The package of claim 22 wherein at least some of the plurality of discrete openings are disposed in a valley of the angled top support surface.

25. The package of claim 24 wherein the discrete openings are disposed in a radial configuration.

26. A microwavable packaged food product comprising an outer package and a quantity of raw bacon contained therein, the packaged food product being configured to facilitate heating of the food product in a microwave oven, wherein:

the bacon comprises at least about 7.5% to about 18.5% protein;

the package further comprises a multilayer microwavable support having at least three layers including:

a susceptor layer including a microwave energy interactive material and a plurality of discrete openings disposed therein, the discrete openings being disposed at a center of the microwavable support;

an absorbent pad layer having a flexible paper-based material suitable for absorbing moisture and grease; and a paperboard base layer having an upper support, a lower support, and side support walls connecting the upper support to the lower support, the susceptor layer disposed on the upper support and the absorbent pad layer disposed on the lower support, the absorbent pad layer being between the upper support and the lower support; and wherein the microwaveable support is reconfigurable from a first transport configuration to a second cooking configuration by shifting the upper support relative to the lower support, wherein in the first transport configuration a first portion and a second portion of the susceptor layer and the upper support at the center of the microwaveable support are substantially planar, wherein in the second cooking configuration the upper support and lower support are at least spaced from one another at the side support walls and the first portion and the second portion of the susceptor layer and the upper support at the center of the microwavable support extend at an oblique angle relative to one another to form an angled, upwardly facing support surface to support the bacon and that directs grease toward the discrete openings during microwave cooking of the bacon, the upper support at the center of the microwaveable support resting on the absorbent pad layer of the lower support with the discrete openings extending through the upper support such that the absorbent pad layer draws moisture and grease from the upper support to the absorbent pad layer disposed on the lower support through the discrete openings, wherein an amount of grease generated during microwave cooking of the bacon that is not absorbed by the support is less than about 10%.

27. The microwavable packaged food product of claim 26 wherein the paperboard base layer is under the absorbent pad layer such that grease on the susceptor layer drains through the discrete openings directly to the absorbent pad layer.

28. The microwavable packaged food product of claim 27 wherein the susceptor layer and the absorbent pad layer are laminated together.

29. The microwavable packaged food product of claim 26 wherein in the second cooking configuration the upwardly facing support surface is sloped toward at least some of the plurality of discrete openings.

30. The microwavable packaged food product of claim 26 wherein at least some of the plurality of discrete openings are disposed in a valley of the angled, upwardly facing surface.

* * * * *